US011028633B2

(12) United States Patent
Fitzgibbon et al.

(10) Patent No.: US 11,028,633 B2
(45) Date of Patent: Jun. 8, 2021

(54) AUTOMATIC CONTROL OF A MOVABLE BARRIER

(71) Applicant: The Chamberlain Group, Inc., Oak Brook, IL (US)

(72) Inventors: James J. Fitzgibbon, Batavia, IL (US); James D. Johnson, Algonquin, IL (US)

(73) Assignee: The Chamberlain Group, Inc., Oak Brook, IL (US)

( * ) Notice: Subject to any disclaimer, the term of this patent is extended or adjusted under 35 U.S.C. 154(b) by 239 days.

(21) Appl. No.: 16/212,109

(22) Filed: Dec. 6, 2018

(65) Prior Publication Data

US 2020/0181969 A1 Jun. 11, 2020

(51) Int. Cl.
*E05F 15/73* (2015.01)
*G07C 9/00* (2020.01)

(52) U.S. Cl.
CPC ..... *E05F 15/73* (2015.01); *G07C 9/00896* (2013.01); *E05Y 2900/106* (2013.01); *G07C 2009/00928* (2013.01)

(58) Field of Classification Search
None
See application file for complete search history.

(56) References Cited

U.S. PATENT DOCUMENTS 6,271,765 B1 8/2001 King
6,615,132 B1 9/2003 Nagasaka
6,737,968 B1 5/2004 Ergun
9,715,772 B2 * 7/2017 Bauer ..... G07C 9/20
9,879,466 B1 * 1/2018 Yu ..... E05F 15/76
9,984,561 B1 * 5/2018 Swafford ..... G08C 17/02
10,557,299 B2 * 2/2020 Lickfelt ..... E05F 15/73
10,563,456 B2 2/2020 Bodurka
2004/0257199 A1 * 12/2004 Fitzgibbon ..... G07C 9/00182 340/5.71
2006/0184456 A1 * 8/2006 de Janasz ..... G06Q 20/40 705/72
2006/0202815 A1 * 9/2006 John ..... G08B 21/14 340/531
2010/0171588 A1 * 7/2010 Chutorash ..... E05F 15/668 340/5.71
2013/0117078 A1 * 5/2013 Weik, III ..... E05F 15/70 705/13
2013/0147600 A1 6/2013 Murray
(Continued)

OTHER PUBLICATIONS

U.S. Appl. No. 16/923,534, filed Jul. 8, 2020; (pp. 1-75).

*Primary Examiner* — Chico A Foxx
(74) *Attorney, Agent, or Firm* — Fitch, Even, Tabin & Flannery LLP

(57) ABSTRACT

In one aspect, an in-vehicle computing device is provided for controlling operation of a movable barrier operator. The in-vehicle computing device includes a sensor configured to detect a vehicle characteristic and communication circuitry operable to cause automatic operation of the movable barrier operator by communicating with the movable barrier operator. The in-vehicle device further includes a processor operatively coupled to the communication circuitry, the sensor, and the memory. The processor configured to determine satisfaction of a user account condition and, upon the user account condition not being satisfied, to inhibit the communication circuitry from initiating automatic operation of the movable barrier operator.

27 Claims, 6 Drawing Sheets

(56) References Cited

U.S. PATENT DOCUMENTS

| | | | | |
|---|---|---|---|---|
| 2013/0147616 | A1* | 6/2013 | Lambert | G07C 5/085 340/426.1 |
| 2013/0179238 | A1* | 7/2013 | Warner, IV | G07B 15/00 705/13 |
| 2014/0118111 | A1* | 5/2014 | Saladin | E05F 15/77 340/7.51 |
| 2015/0137941 | A1* | 5/2015 | Bauer | G07C 9/20 340/5.61 |
| 2017/0154482 | A1* | 6/2017 | Osborne | E05F 15/77 |
| 2018/0268238 | A1* | 9/2018 | Khan | G06F 16/583 |
| 2019/0048639 | A1* | 2/2019 | Lickfelt | E05F 15/40 |
| 2019/0048644 | A1* | 2/2019 | Lickfelt | E05F 15/73 |
| 2019/0180124 | A1* | 6/2019 | Schindler | G06K 9/00791 |
| 2019/0200225 | A1 | 6/2019 | Fitzgibbon | |
| 2019/0244448 | A1* | 8/2019 | Alamin | G07C 9/20 |
| 2020/0236552 | A1 | 7/2020 | Fitzgibbon | |
| 2020/0240198 | A1 | 7/2020 | Cate | |
| 2020/0242862 | A1 | 7/2020 | Cate | |

* cited by examiner

AUTOMATIC CONTROL OF A MOVABLE BARRIER

FIELD

The subject matter of this application relates to movable barrier operators, and more specifically, to automatically controlling operation of a movable barrier operator based on a characteristic of a vehicle.

BACKGROUND

Various types of remote controls for movable barrier operators are known in the art for controlling the position of a movable barrier associated with the movable barrier operator, such as a radio frequency transmitter. The transmitter may be part of or connected to in-vehicle hardware such as an infotainment or navigation system that allows a user to set a geographic area of the user's home and the transmitter will transmit a signal to open or close the movable barrier upon the vehicle entering or exiting the area. In this manner, the user does not need to manually actuate the transmitter each time the vehicle enters or exits the area.

Elements in the figures are illustrated for simplicity and clarity and have not necessarily been drawn to scale. For example, the dimensions and/or relative positioning of some of the elements in the figures may be exaggerated relative to other elements to help to improve understanding of various embodiments of the present teachings. Also, common but well-understood elements that are useful or necessary in a commercially feasible embodiment are often not depicted in order to facilitate a less obstructed view of these various embodiments of the present teachings. Certain actions and/or steps may be described or depicted in a particular order of occurrence while those skilled in the art will understand that such specificity with respect to sequence is not actually required. The terms and expressions used herein have the ordinary technical meaning as is accorded to such terms and expressions by persons skilled in the technical field as set forth above except where different specific meanings have otherwise been set forth herein. The word "or" when used herein shall be interpreted as having a disjunctive construction rather than a conjunctive construction unless otherwise specifically indicated.

DETAILED DESCRIPTION

Figure 1:
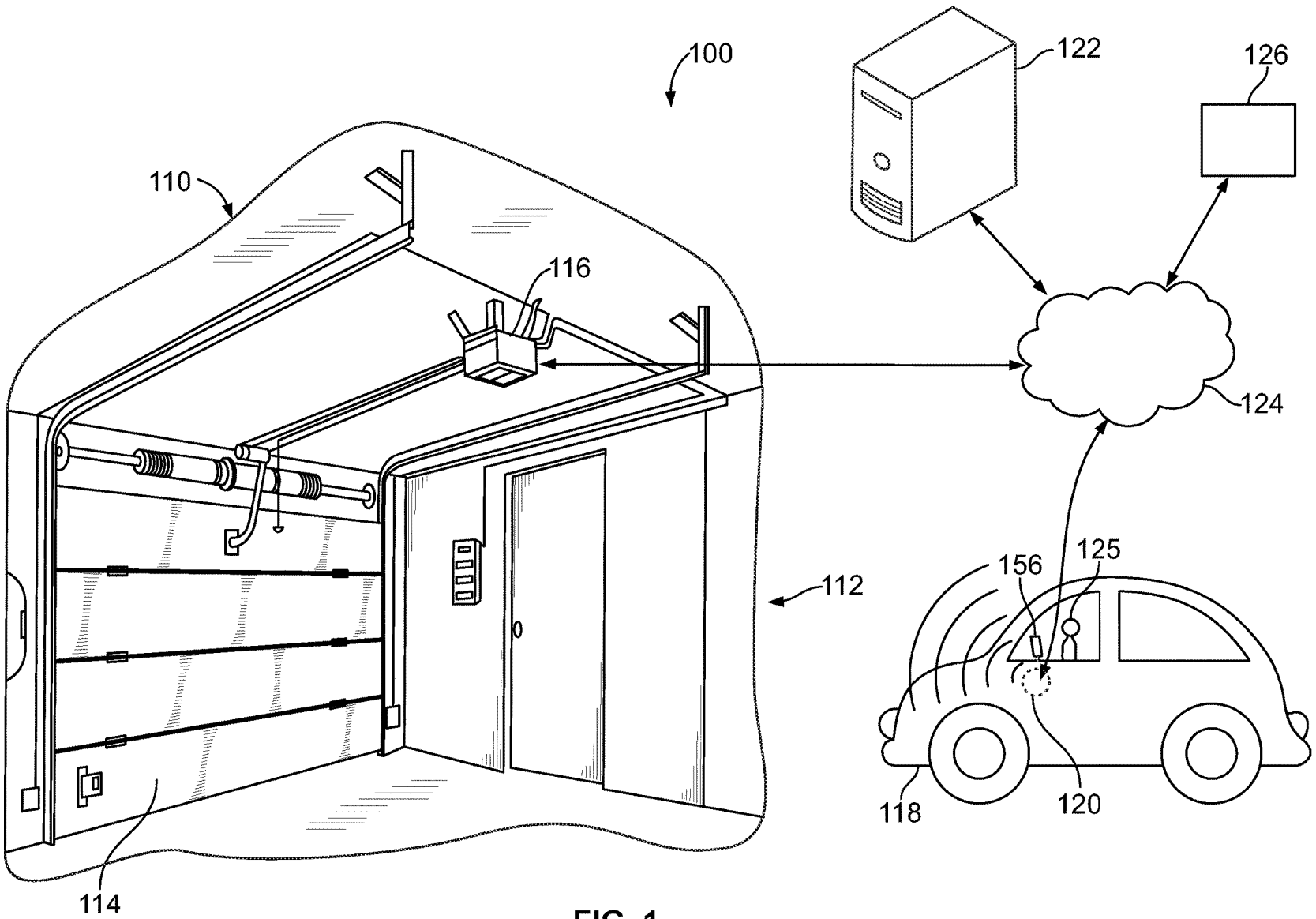
FIG. 1 is an example schematic representation of a system for automatically controlling operation of a movable barrier operator that includes an in-vehicle device.
Figure 2:
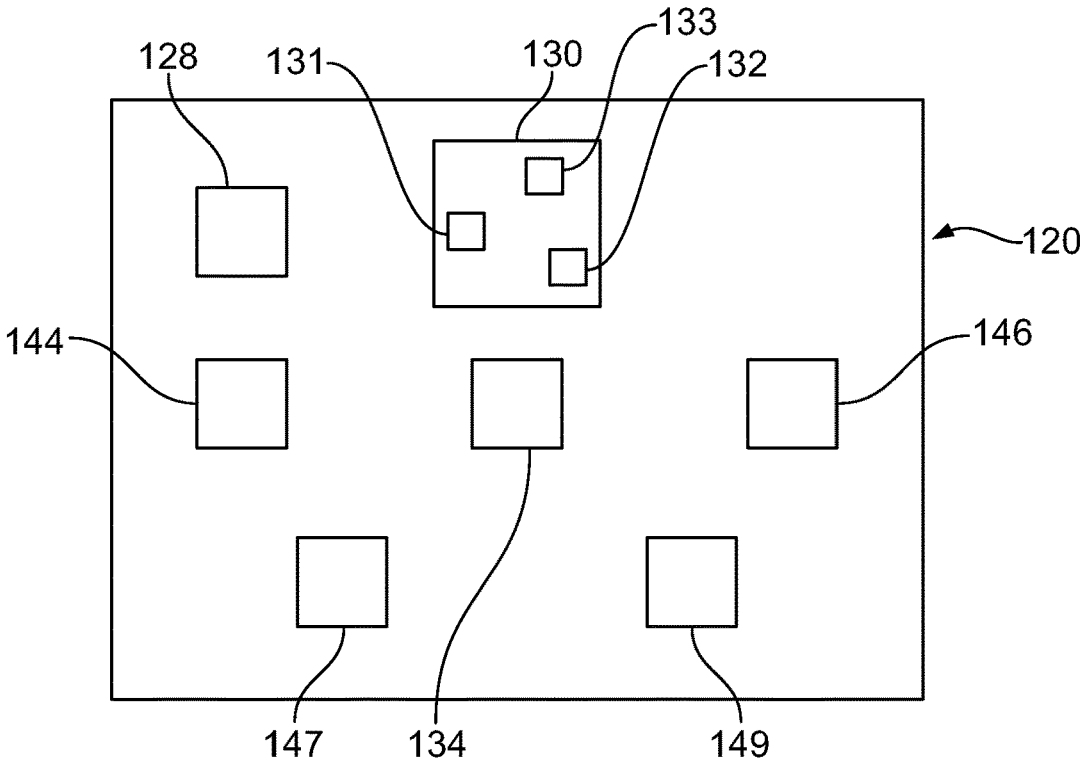
FIG. 2 is an example schematic representation of the in-vehicle device of FIG. 1.

Referring now to the drawings, and in particular to FIGS. 1 and 2, a system 100 is provided for automatically controlling a movable barrier operator system 110 at a secured area, such as a garage 112, having a movable barrier, such as a garage door 114, and a movable barrier operator 116 (hereinafter "MBO 116"). Examples of movable barrier operators include a chain or belt-driven garage door openers, gate operators, roller shutter systems, and jackshaft garage door operators. A vehicle 118 includes an in-vehicle device 120, such as a human-machine interface of the vehicle 118 connected to or including a transmitter, for automatically changing the state of the movable barrier 114 when the vehicle 118 is near the garage 112. More specifically, the in-vehicle device 120 is configured to communicate directly with the MBO 116 via radio frequency signals (e.g., radio frequency signals in the 300 MHz to 900 MHz range) or indirectly via a network 124 and a server computer, such as remote server 122, connected thereto. The network 124 may include one or more networks such as the internet and wide area networks such as 3G, 4G, 4G LTE, 5G cellular networks and low power wide area network technologies, such as WiMAX, LoRaWAN, and LTE-M.

With reference to FIG. 2, the in-vehicle device 120 includes a sensor 128 to detect a vehicle characteristic of the vehicle 118. It is intended that "a" may refer to "at least one" such that references to "the vehicle characteristic" encompasses one, two, or more (e.g. a plurality) vehicle characteristics. Similarly, references to "the user account condition 140" are intended to refer to one or more user account conditions 140.

The in-vehicle device 120 is configured to communicate with the MBO 116 to cause the MBO 116 to open the garage door 114 as the vehicle 118 approaches the garage 112 and close the garage door 114 as the vehicle 118 departs the garage 112. The communications between the in-vehicle device 120 and the MBO 116 (either directly with radio frequency signals or indirectly via the remote server computer 122 and network 124) may include information related to one or more pre-determined user account conditions 140 (see FIG. 4) set by a primary user 125 that specify parameters for automatic operation of the MBO 116. The term "automatic operation" of the MBO 116 is used herein to mean the user does not have to manually operate the in-vehicle device 120 to open or close the garage door 114. The in-vehicle device 120 will automatically trigger operation of the MBO 116 upon: 1) the sensor 128 of the in-vehicle device 120 detecting a vehicle characteristic that indicates a trigger of an automatic operation of the MBO 116; and 2) satisfaction of the user account condition 140. The vehicle characteristic may be, for example, the location of the vehicle 118 and the in-vehicle device 120 may determine where the vehicle 118 is within a predetermined area associated with the MBO system 110. The user account condition operates as a check on whether or not the in-vehicle device 120 automatically operates the MBO 116 independent of whether the sensed vehicle characteristic indicates automatic operation of the MBO 116. For example, if the vehicle 118 enters a geofenced area associated with the MBO 116 and the user account condition 140 is satisfied, then a command signal is automatically communicated to the MBO 116 to open the garage door 112. Conversely, if the vehicle 118 enters the geofenced area and the user account condition 140 is not satisfied, then a command signal is not communicated to the MBO 116 despite the vehicle 118 entering the geofenced area. By utilizing the user account conditions to inform automatic operation of the MBO 116, the in-vehicle device 120 is less likely to operate the MBO 116 when undesired by the user.

The vehicle characteristic may include a characteristic instead of or in addition to vehicle location, such as vehicle speed and/or orientation with respect to the garage 112. The user account condition 140 is a condition that affects the user's interaction with the system 100. The user account condition 140 may be set with regard to characteristics unrelated to the vehicle 118, such as weather, time of day, and who is (or is not) present in a building associated with the garage 112 or area secured by the MBO 116 and movable barrier (e.g. garage door 114). The user account condition 140 may be set at the in-vehicle device 120 or at a computing device 126, such as a smartphone, smart watch, laptop, tablet computer, or desktop computer. Further examples of vehicle characteristics and user account conditions 140 are described in detail below.

Regarding FIG. 2, in one example, the sensor 128 includes a global navigation satellite system (GNSS) receiver, such as a GPS receiver. The GNSS receiver receives location and timing data from satellites 158 (see FIG. 9) and the in-vehicle device 120 determines the location of the vehicle 118 based on the received data. Alternatively or in addition, the sensor 128 includes a sensor that detects a rotation of or otherwise communicates with a vehicle powertrain component that corresponds to the vehicle speed.

The in-vehicle device 120 further includes communication circuitry 130 configured to communicate directly or indirectly with the MBO 116 and operate the MBO 116. For example, the communication circuitry 130 may include a radio frequency signal transmitter 131 (operable within the 300 MHz-900 MHz radio frequency band) configured to send a command signal directly to the MBO 116 to change the state of the garage door 114 based upon a characteristic of the vehicle 118.

The communication circuitry 130 further includes a wide area network interface 132 configured to communicate with the network 124 to send a change of state request to the remote server 122. The change of state request causes the remote server 122 to send a command signal to the MBO 116 and cause the MBO 116 to change the state of the garage door 114 (e.g., close to open or vice versa). Additionally, the communication circuitry 130 may include a short-range wireless interface 133 for communication with the MBO 116. For example, the short-range wireless interface 133 may be configured to communicate with the MBO 116 using Bluetooth, Bluetooth Low Energy (BLE), Near Field Communication (NFC), WiFi, Z-wave and ZigBee protocols.

The in-vehicle device 120 further includes a memory 144 and a processor 146. The memory 144 is configured to store the user account condition 140. The in-vehicle device 120 also has a microphone 149 for receiving voice commands from a user in the vehicle 118. The processor 146 is operatively coupled to the memory 144, the microphone 149, the sensor 128, and the communication circuitry 130. The processor 146 is configured to perform instructions stored in the memory 144, such as determining satisfaction of the user account condition.

In another embodiment, the in-vehicle device 120 is a user's smartphone. The smartphone may communicate with the vehicle 118 to receive data, such as the location and speed of the vehicle 118. The smartphone may also be configured to retrieve the data itself. For example, the smartphone may receive location data from GPS satellites or cellular towers and determine the location of the vehicle 118, determine whether the vehicle 118 is within a geofenced area, and determine whether the user account condition 140 has been satisfied. The smartphone may communicate a state change request to the remote server 122 or connect to the vehicle 118, such as via Bluetooth, and cause a radio signal transmitter of the vehicle 118 to transmit a command signal to the movable barrier operator 116.

Figure 3:
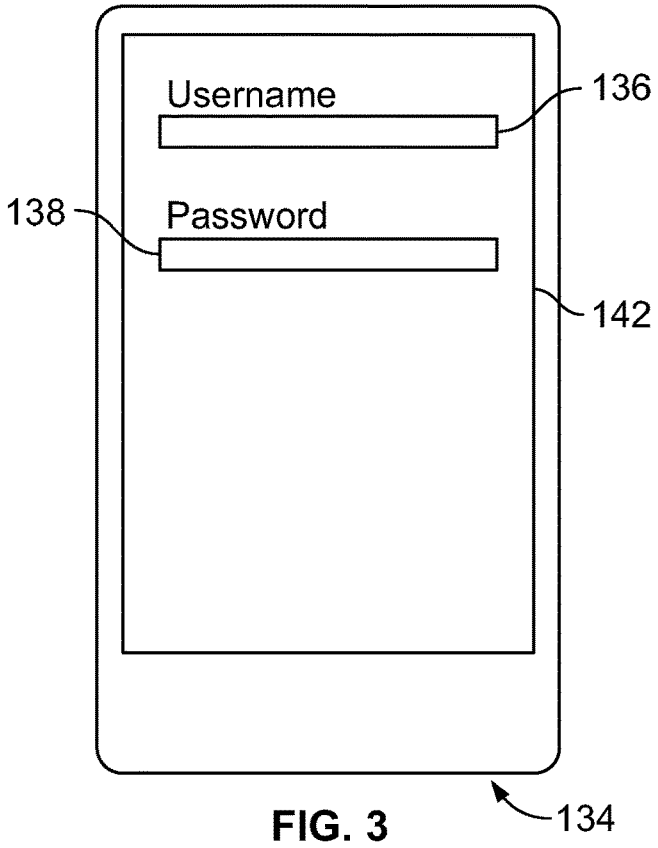
FIG. 3 is a view of an example screen of a user interface of the in-vehicle device of FIG. 2, the screen displaying a prompt to enter login information for a user account.
Figure 4:
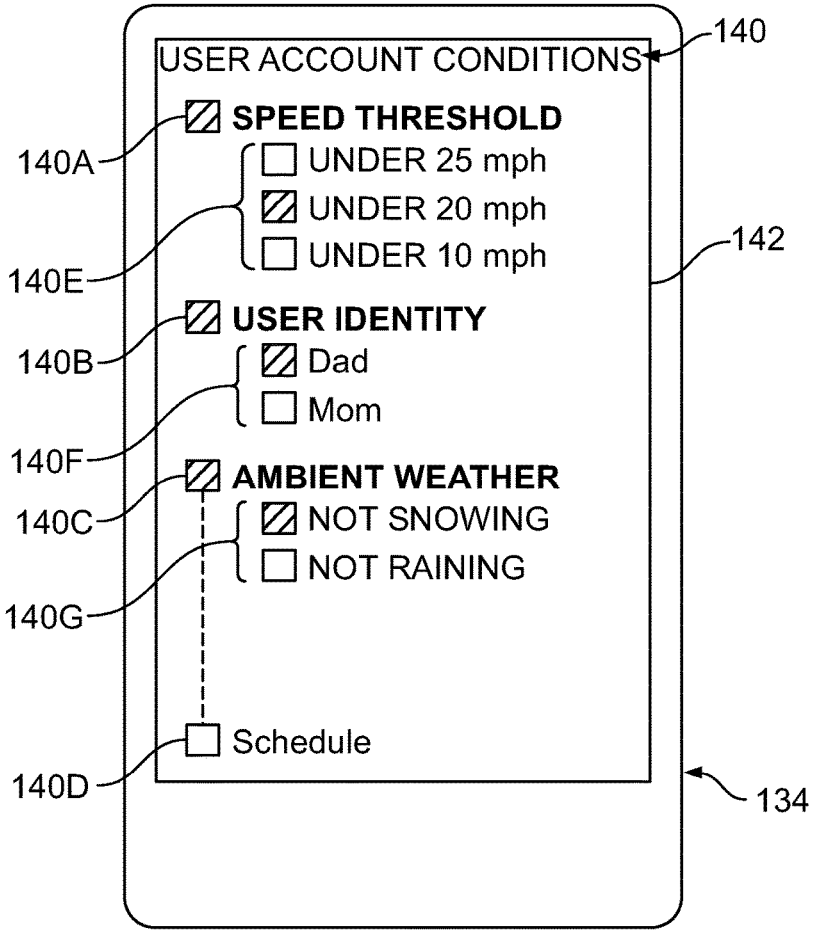
FIG. 4 is a view of the example screen of FIG. 3 displaying user account conditions that limit automatic operation of the movable barrier operator of FIG. 1.

With reference to FIGS. 3 and 4, the account user condition may be set at the in-vehicle device 120 or at the computing device 126. For example, the user may log in to their account at a user interface 134 of the in-vehicle device 120. The user interface 134 may include a touch screen 142, a microphone, speaker, and/or a keyboard. The user may enter account information such as credentials including a username 136 and password 138 at the user interface 134. Upon successful log in, the user interface 134 may display a graphical user interface for receiving user account conditions that limit automatic operation of the MBO 116 as shown in FIG. 4. The user may log into their account and adjust their user account conditions 140 at any time. For example, the user interface 134 may have a list with one or more user conditions 140 that the user may select. In this example, the user account conditions 140 refer to three characteristics: vehicle speed threshold 140A, user identity 140B, and ambient weather 140C. The user may select (e.g., by touching the touch screen 142 of the user interface 134) which conditions 140 the user wants to have considered for automatic operation of the MBO 116. The user may also leave unchecked characteristics (e.g. schedule characteristic 140D) that do not need to be satisfied for automatic operation of the MBO 116. As shown in FIG. 4, the user has selected the vehicle speed threshold 140A as being a user account condition 140 that will be considered. The user has further selected that the speed threshold 140E of the vehicle 118 as it approaches the garage 112 be under 20 mph. The user has also selected the user identity 140B to be considered for automatic operation of the MBO 116. For example, the in-vehicle device 120 may include a sensor 147 operatively coupled to the processor 146 and configured to detect the identity of a user-specific device 156 (see FIG. 1) associated with a user in the vehicle 118, such as a smartphone, smart watch, key, or key fob. The processor 146 determines if the selected user identity 140F matches the in-vehicle identity detected by the sensor 147. Alternatively or additionally, the sensor 147 may be operable to detect a specific user/driver via weight, biometrics (e.g., facial, iris, fingerprint recognition) and/or seat adjustment or steering wheel adjustment settings. The user has also indicated the ambient weather conditions outside of the garage 112 to be one of the user account conditions 140 considered for automatic operation of the MBO 116. The in-vehicle device 120 may receive ambient weather data via the communication circuitry 130, such as from satellite 158 or from the user-specific device 156. The user has specified that it not be snowing 140G. Thus, the in-vehicle device 120 will not automatically operate the MBO 116 if it is snowing. The selected user account conditions 140A, 140B, 140C may be stored in the memory 144 of the in-vehicle device 120. Other examples of user account conditions 140 are described below.

For example, as the vehicle 118 approaches the garage 112, the processor 146 uses GNSS data from the sensor 128 to first determine whether the vehicle 118 is within a geofenced area associated with the garage 112. In this example, the location of the vehicle 118 is a vehicle characteristic that must be satisfied before the one or more user account conditions 140 are checked. The processor 146 then determines whether the user account conditions 140A, 140B, 140C are satisfied. More specifically, if (1) the speed of the vehicle 118 is below 20 mph, (2) the user is "dad," and (3) it is not snowing outside, then the user account conditions 140A, 140B, 140C have been satisfied. The processor 146 will then cause the communication circuitry 130 to automatically transmit the command signal from the radio frequency transmitter 131 to the MBO 116 to open the garage door 114. In another example, if the user condition 140A, 140B, 140C are satisfied, the processor 146 will cause the communication circuitry 130 to transmit the state change request to the remote server 122 via the network 124 and the remote server 122 will communicate a state change command to the MBO 116.

Figure 5:
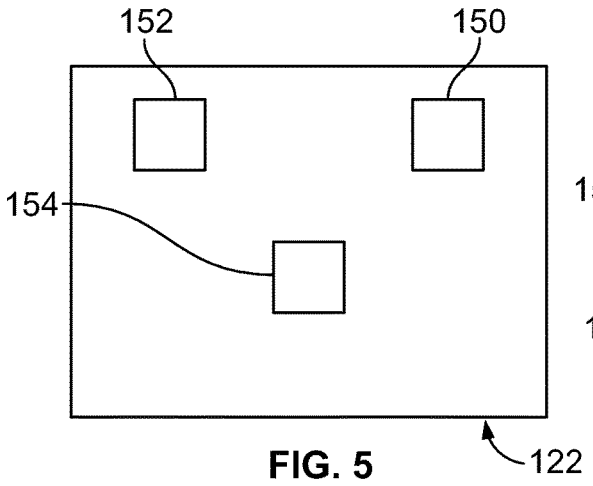
FIG. 5 is an example schematic representation of a remote server computer of the system of FIG. 1.

The remote server computer 122 facilitates operation of the MBO 116. The remote server 122 may make decisions in conjunction with or in place of decision making at the in-vehicle device 120, such as whether the vehicle characteristic detected by the sensor 128 indicates automatic operation of the MBO 116 and whether the user account condition 140 has been satisfied. For example and with reference to FIG. 5, the remote server computer 122 includes a communication interface 150 configured to communicate with the MBO 116 and cause the MBO 116 to open the garage door 114. The communication interface 150 is further configured to receive data from the in-vehicle device 120 via the network 124 regarding the vehicle characteristic of the vehicle 118. Additionally, the communication interface 150 receives the user account condition 140 from the in-vehicle device 120, the computing device 126 or the user-specific device 156. The server computer 122 also has a memory 152 to store the user account condition 140, as well as a processor 154 that is operatively coupled to the communication interface 150 and the memory 152. The processor 154 may determine whether the vehicle characteristic of the vehicle 118 indicates automatic operation of the MBO 116 and whether the user account condition 140 is satisfied. If the vehicle characteristic indicating automatic operation of the MBO 116 has been received and the user account condition 140 has been satisfied, then the server computer 122 will communicate a state change command to the MBO 116 via the network 124 to open the garage door 114. For example, the server computer 122 may send a message to the client MBO 116. However, in one embodiment, no state change command is sent if the vehicle characteristic indicates automatic operation but fewer than all of the user account conditions have been satisfied.

Figure 6:
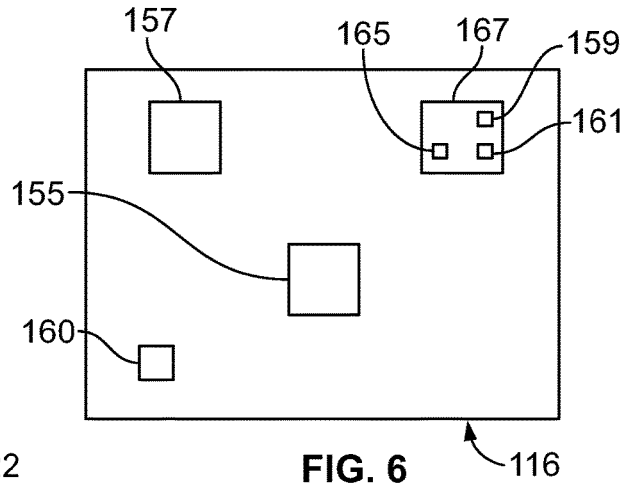
FIG. 6 is an example schematic representation of the movable barrier operator of the system of FIG. 1.

With reference to FIG. 6, the MBO 116 may have a motor 157 configured to be connected to the movable barrier 114. The MBO 116 may also include a memory 160, wherein the memory 160 may store identification and security (e.g. rolling code) information for authorized remote controls. The MBO 116 may also have communication circuitry 167 wherein the communication circuitry 167 is configured to receive the characteristic of the vehicle 118 and the user account condition 140 from the remote server 122 or directly from the in-vehicle device 120. For example, the communication circuitry 167 may include circuitry for direct radio frequency communication between the vehicle 118 and the MBO 116 such as a radio frequency signal receiver or transceiver 159 (operating within the 300 MHz-900 MHz radio frequency band). The radio frequency signal transceiver 159 of the MBO 116 may receive a command signal from the radio frequency transmitter 131 of the in-vehicle device 120 to change the state of the garage door 114 (e.g. from closed to open).

The communication circuitry 167 may further include a long-range wireless transceiver 161 configured to communicate with the remote server 122 over the network 124. The transceiver 161 may receive a state change command from the remote server 122 (via the network 124) to cause the MBO 116 to change the state of the garage door 114. The transceiver 161 may also communicate information back to the network 124, such as information identifying a user of the vehicle 118. The transceiver 161 may communicate with the network 124 via a wireless gateway or access point, such as a WiFi router. Additionally, the communication circuitry 167 may include a short-range wireless transceiver 165 for communication with the short-range transmitter 133 of the in-vehicle device 120. For example, the short-range wireless transceiver 165 may be configured to receive the command signal from the in-vehicle device 120 over a short-range wireless protocol, such as Bluetooth.

The long-range wireless transceiver 161 and the short-range wireless transceiver 165 may both be configured to receive characteristics of the vehicle 118 from a plurality of local devices. For example, the wide area network interface 132 and short-range transmitter 133 of the in-vehicle device 120 may be in communication with other local wireless devices (e.g., home appliances, other vehicles, smartphones, etc.) to exchange and collect data. The long-range wireless transceiver 161 and the short-range wireless transceiver 165 may receive data from the other devices as part of a mesh network.

For example, the long-range wireless transceiver 161 of the MBO 116 may receive a signal from a LoRa-based sensor for wireless, long-range radio transmissions with low power consumption mounted to a stoplight or from a V2X (vehicle to anything) component mounted to a stop sign at an intersection near the garage 112 upon the sensor detecting a beacon signal from the in-vehicle device 120. The MBO 116 would thereby be able to determine the vehicle 118 is nearby.

The MBO 116 also includes a processor 155. The processor 155 is operatively coupled to the motor 157 and the communication circuitry 167. The MBO 116 may make decisions in conjunction with or in place of decision making at the in-vehicle device 120 and/or the remote server 122. The decisions may include deciding whether the vehicle characteristic identified by the sensor 128 indicates automatic operation of the MBO 116 and whether the user account condition 140 has been satisfied. For example, the processor 155 may be configured to cause the motor 157 to move the movable barrier 114 upon receiving the characteristic of the vehicle 118 indicating automatic operation of the MBO 116 and the user account condition 140 being satisfied. Conversely, the processor 155 may be configured to not effect movement of the movable barrier 114 upon the received characteristic of the vehicle 118 indicating automatic operation of the MBO 116 but fewer than all of the user account conditions being satisfied.

Figure 7:
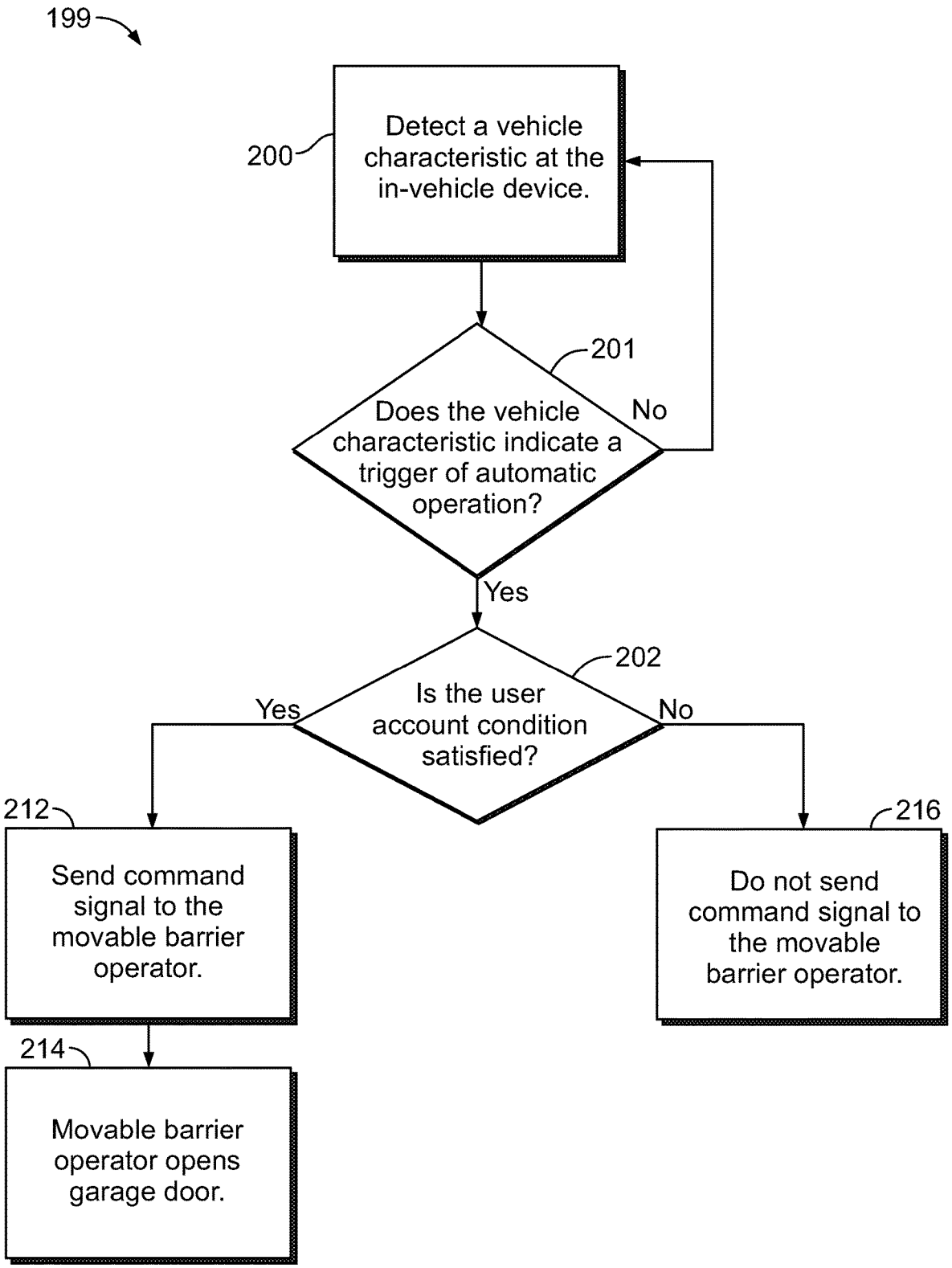
FIG. 7 is an example flow diagram of a method of remotely controlling operation of a movable barrier operator with an in-vehicle device.

With reference to FIG. 7, a method 199 is provided for automatically opening the garage door 114 with the in-vehicle device 120. At operation 200, the sensor 128 of the in-vehicle device 120 detects a characteristic of the vehicle 118, such as the vehicle location. At operation 201, the processor 146 of the in-vehicle device 120 determines whether the vehicle characteristic indicates automatic opening of the garage door 114. For example, the sensor 128 detects the location of the vehicle 118 and the processor 146 determines whether the vehicle 118 is within a geofenced area near the garage 112. If the vehicle characteristic does not indicate automatic operation, the processor 146 continues to monitor the sensor 128 for detection of the vehicle characteristic that indicates automatic operation of the MBO 116.

If at operation 201 the vehicle characteristic indicates automatic operation, the processor 146 of the in-vehicle device 120 determines whether the user account condition 140 was satisfied at operation 202. For example, the vehicle speed threshold 140A may be the only user account condition 140 set by the user. The processor 146 receives vehicle speed information via the communication circuitry 130, which may receive the vehicle speed information from an electronic control unit (ECU) via a controller area network (CAN) bus of the vehicle 118. The processor 146 determines whether the user account condition 140A is satisfied by comparing the current vehicle speed to the selected threshold 140E. If the user account condition 140A is satisfied, then at operation 212, the in-vehicle device 120 will send a radio frequency command signal to the movable barrier operator 116 from the radio frequency transmitter 131. In another embodiment, at operation 212 the in-vehicle device 120 sends a status change request to the remote server 122 via the network 124 to cause the remote server 122 to send a state change command to the MBO 116.

At operation 214, the command signal is received at the movable barrier operator 116 and the movable barrier operator 116 operates to open or close the garage door 114. If at operation 202 the user account condition 140 is not satisfied, then at operation 216 no command signal or state change request will be transmitted 218 from the in-vehicle device 120, and the garage door 114 will remain in its current state.

Figure 8:
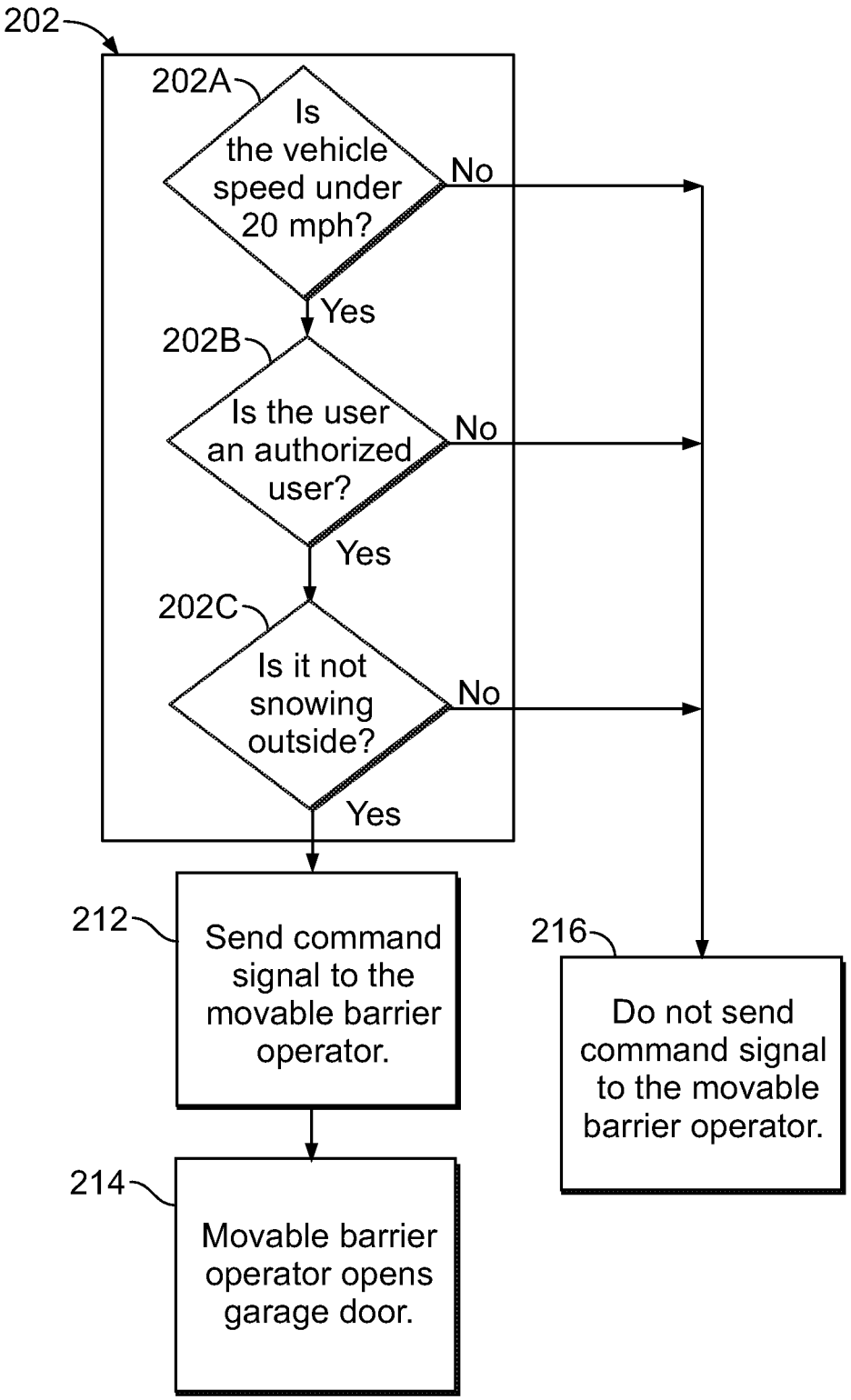
FIG. 8 is an example flow diagram of a portion of the method of FIG. 7 including an operation of sequentially checking satisfaction of user account conditions prior to operating the movable barrier operator.

With reference to FIG. 8, an example of the operations 202, 212, 214, 216 of method 199 are discussed in greater detail wherein the user account conditions 140 include user account conditions 140A, 140B, 140C. At operation 202A, the processor 146 of the in-vehicle device 120 determines whether the user account condition 140A is satisfied, i.e., whether the vehicle 118 is travelling under 20 mph.

If the user account condition 140A is satisfied, then the processor 146 proceeds to operation 202B to determine whether the user account condition 140B is satisfied, i.e., whether a specified user is in the vehicle 118. As described above with respect to FIG. 4, the sensor 147 of the in-vehicle device 120 may be configured to detect the identity of a computing device (such as a smartphone) of a user in the vehicle 118. The user's presence in the vehicle 118 can be inferred from the presence of the user's computing device in the vehicle 118.

If the user account conditions 140 of operations 202A, 202B are satisfied, then at operation 202C, the processor 146 determines whether the user account condition 140C has been satisfied. If the processor 146 determines that it is not snowing outside the garage 112, then all of the user conditions 140 have been satisfied, and at operation 212 the in-vehicle device 120 sends a radio frequency command signal to the MBO 116 or communicates a state change request to the remote server 122 via the network 124.

At operation 214, a command signal is received at the MBO 116 and the movable barrier operator 116 operates to open the garage door 114 to allow entry of the vehicle 118. If any of the user account conditions 140A, 140B, 140C are not satisfied at operations 202A, 202B, 202C, then at operation 216 no signal will be transmitted from the in-vehicle device 120, and the garage door 114 will remain closed.

The operation 202 may be performed in a number of approaches. For example, the ambient weather may be checked before the vehicle speed. Further, the user may adjust the user account condition 140 via the user interface 134 so that fewer than all of the user account conditions 140A, 140B, 140C must be satisfied. Alternatively, the various user account conditions 140 may be associated with importance or weighting values. For example, the user account condition 140 at operation 202 may be satisfied if both the vehicle speed threshold condition 140A and the user identity condition 140B are satisfied but the ambient weather condition 140C is not. Conversely, the user account condition 140 at operation 202 would not be satisfied if the vehicle speed threshold condition 140A was satisfied but the user identity condition 140B and the weather condition 140C were not. This different outcome would occur because the user identity condition 140B has a default normal importance and must be satisfied while the user has indicated the ambient weather condition 140C has a modified, lower importance that can be ignored if the other user account conditions 140A, 140B are satisfied.

Figure 9:
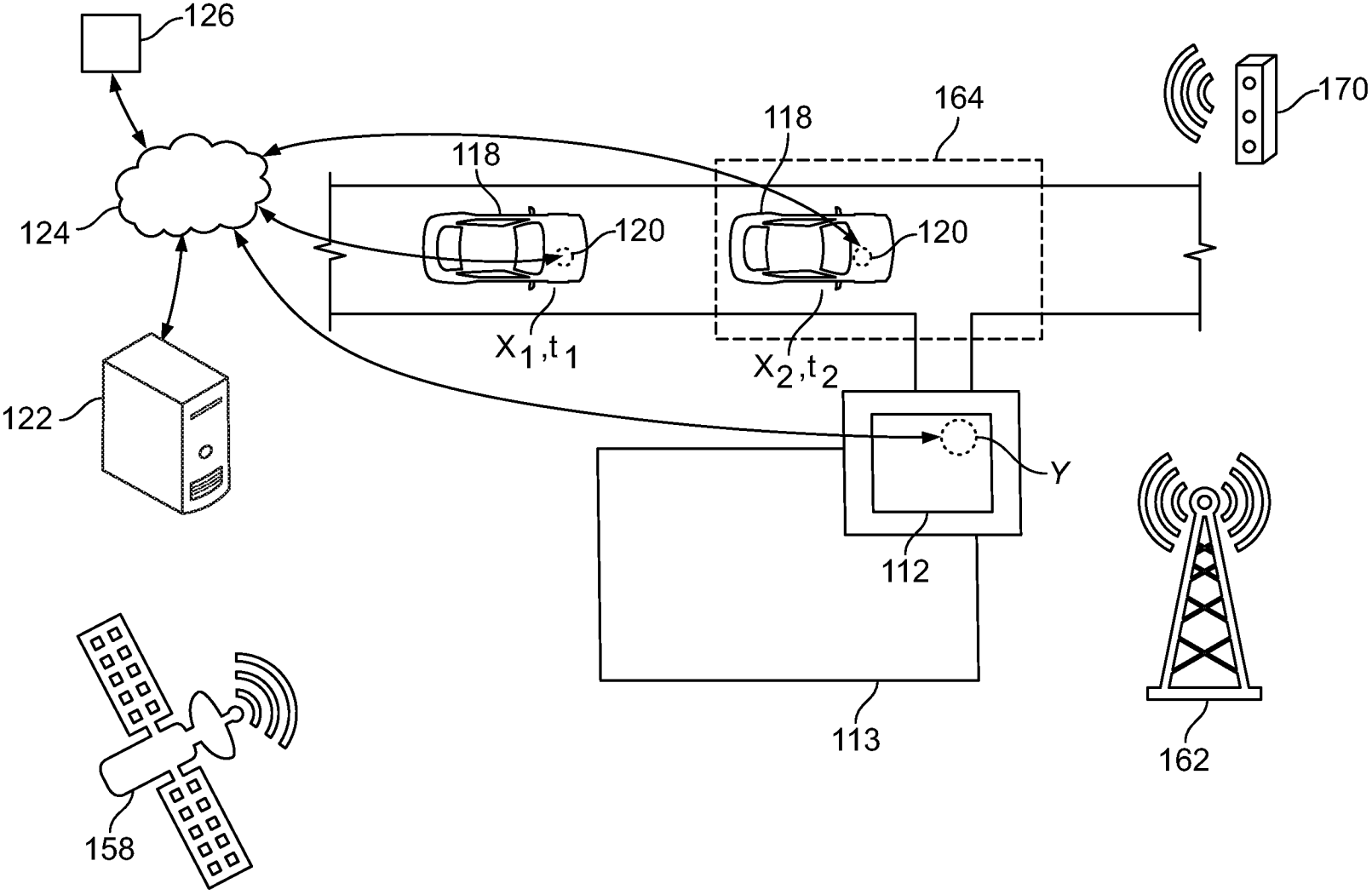
FIG. 9 is an example schematic representation of an in-vehicle device automatically controlling a movable barrier operator.

FIG. 9 illustrates an example of automatic operation of the system 110. In this example, the vehicle 118 is located at a first position, $x_1$, at a time, $t_1$, and the MBO 116 is at a location y (e.g., the garage 112) associated with a building 113, such as a house. The sensor 128 of the in-vehicle device 120 determines the location from data received from the satellite 158. The memory 144 of the in-vehicle device 120 is configured to store data representative of the location of the MBO 116 and the vehicle 118. The in-vehicle device 120 may receive additional data, such as data from a nearby stoplight 170 or cellular tower 162. The in-vehicle device 120 may have been set to automatically operate the MBO 116 if the vehicle 118 is within a certain physical proximity of the garage 112, such as within a geofence 164. Thus, in this example, the vehicle characteristic is the location $x_1$ of the vehicle 118. If the vehicle 118 is determined to be within the geofence 164, the vehicle characteristic indicates automatic operation of the MBO 116. At time $t_2$, the vehicle 118 is within the geofence 116 such that the processor 146 determines the location of the vehicle 118 indicates automatic operation of the MBO 116.

As another example, the vehicle characteristic may be a distance between the vehicle 118 and the location y. The processor 146 determines that the distance from the vehicle 118 to the location y at position $x_1$ of the vehicle 118 at time $t_1$ is 75 feet; however, the predetermined distance set by the user is 50 feet. As a result, the location of the vehicle 118 does not indicate automatic operation of the MBO 116.

At a later time $t_2$, the sensor 128 of the in-vehicle device 120 receives the location data indicating a new location $x_2$. The processor 146 determines that the distance between the vehicle 118 and the location y is now within 25 feet. At this point, the processor 146 determines the location of the vehicle 118 indicates automatic operation of the MBO 116.

Upon the vehicle characteristic indicating automatic operation of the MBO 116, the processor 146 determines whether the user account condition 140 has been satisfied as discussed above with respect to FIG. 8. The processor 146 in response to the user account condition 140 being satisfied, causes the communication circuitry 130 to communicate the command signal to the MBO 116. It will be appreciated that the order of operations 200, 201 and 202 (see FIG. 7) could be reversed or performed in parallel. For example, the processor 146 could continually monitor whether the user account condition 140 is satisfied and, if the sensor 128 detects a vehicle characteristic that indicates automatic operation of the MBO 116 while the user account preference 140 is satisfied, the processor 146 will cause the communication circuitry 130 to transmit the command signal or the state change request.

In one embodiment, the in-vehicle device 120 determines whether the vehicle characteristic indicates automatic operation of the MBO 116 and whether the user account condition 140 has been satisfied. In another embodiment, the in-vehicle device 120 communicates data associated with the vehicle characteristic (e.g., the location) to the remote server 122 and the remote server processor 155 determines whether the vehicle characteristic indicates automatic operation of the MBO 116, e.g. the vehicle 118 is within the geofence 164. The processor 155 of the remote server 122 also determines whether the user account condition 140 is satisfied. As an example, the in-vehicle device 120 may communicate vehicle speed and in-vehicle user identity data to the remote server 122. The remote server 122 retrieves weather information from the internet (e.g., street-level or pinpoint weather data based on vehicle location $x_2$). With this data, the remote server 122 can determine whether the user account condition 140 is satisfied and, if so, send a state change command to the MBO 116. In other words, the remote server 122 may determine whether to change the state of the garage door 114.

Various user account conditions 140 may be utilized with the system 100. For instance, a user may set a user account condition 140 to be a particular direction of travel of the vehicle 118. For example, the user account condition 140 to be satisfied is that the vehicle 118 is approaching the garage 112 from the east. The vehicle characteristic includes a detected direction of travel of the vehicle, and the processor 146 is configured to determine whether the direction of travel satisfies the directional requirement. As another example, the user account condition 140 may include whether the vehicle 118 applies its brakes, which indicates the vehicle 118 is slowing down to enter a driveway, alleyway, side street or the garage 112.

In another example, the user account condition 140 may be that the in-vehicle user identity be confirmed with a voice command. More specifically, the processor 146 of the in-vehicle device 120 is operably coupled to the microphone 149 and is configured to determine if the user's voice matches an approved user voice. Another user account condition 140 may be a secret code word spoken by a user and received by the microphone 149 in the vehicle 118. The user says the code word into the microphone 149 upon the vehicle 118 entering the geofence 164, and the processor 154 determines whether the code word matches the preset code word of the user account condition 140. If there is a match, the command signal is automatically sent to the MBO 116 to open the garage door 114.

User conditions 140 may be utilized that are unrelated to the vehicle. For example, certain days and/or times for automatic operation of the MBO 116 may be desired. If a user arrives home every weekday between 5 pm and 6 pm, and sets a user account condition 140 to be vehicle arrival between 5 pm and 6 pm, then arrival of the vehicle 118 in the geofenced area 164 between 5 pm and 6 pm on a weekday will cause the in-vehicle device 120 to automatically operate the MBO 116. Furthermore, it may be that the user condition 140 is a particular time window such that automatic activation of the MBO 116 may never occur outside of the time window. For example, the user may set a user account condition 140 that indicates automatic operation of the MBO 116 is never to occur between the hours of 10 pm and 6 am.

The user account condition 140 may be related to who is in the building 113. The communication circuitry 130 of the in-vehicle device 120 may be configured to receive identity data of a person (or people) in the building 113. For example, a home automation system associated with the building 113 may detect smartphones of family members connected to the home Wi-Fi. If only a teenager is home, the user account condition 140 would not be satisfied. If the teenager and a parent is home or if no one is home, the user account condition 140 would be satisfied.

While there have been illustrated and described particular embodiments of the present invention, it will be appreciated that numerous changes and modifications will occur to those skilled in the art, and it is intended for the present invention to cover all those changes and modifications which fall within the scope of the appended claims. For example, portions of the method 199 may be performed at different components of the system 100. As one example in this regard, the in-vehicle device 120 may perform operations 200, 201 and the remote server 122 performs operations 202, 212.

What is claimed is:

1. A movable barrier operator comprising:

a motor configured to be connected to a movable barrier;

communication circuitry configured to receive data representative of a vehicle characteristic that indicates triggering of an automatic operation of the movable barrier operator;

the communication circuitry configured to receive from an in-vehicle device a user account condition, established at the in-vehicle device, to be satisfied for automatic operation of the movable barrier operator to occur;

the communication circuitry configured to receive information from the in-vehicle device; and a processor operatively coupled to the motor and the communication circuitry, the processor configured to determine satisfaction of the user account condition based upon the information received by the communication circuitry from the in-vehicle device and, upon the user account condition not being satisfied based on the information, to inhibit operation of the motor despite the triggering.

2. The movable barrier operator of claim 1 wherein the communication circuitry is configured to receive a radio frequency command signal from a remote control and the processor is configured to inhibit operation of the motor by ignoring the radio frequency command signal.

3. The movable barrier operator of claim 1 wherein the communication circuitry is configured to receive the information from the in-vehicle device including one or more vehicle characteristics and the processor is configured to determine satisfaction of the user account condition based at least in part on the one or more vehicle characteristics.

4. The movable barrier operator of claim 1 wherein the user account condition includes an approved user identity, the communication circuitry is configured to receive the information from the in-vehicle device including information indicative of an in-vehicle user identity, and the processor is configured to determine satisfaction of the user account condition by determining whether the in-vehicle user identity corresponds to the approved user identity.

5. The movable barrier operator of claim 1 wherein the user account condition includes a time window, and the processor is configured to determine satisfaction of the user account condition by determining whether the vehicle characteristic occurs within the time window.

6. The movable barrier operator of claim 1 wherein the user account condition includes a direction of vehicle travel, the communication circuitry is configured to receive the information from the in-vehicle device including a detected direction of vehicle travel, and the processor is configured to determine satisfaction of the user account condition by determining whether the detected direction of vehicle travel corresponds to the direction of vehicle travel of the user account condition.

7. The movable barrier operator of claim 1 wherein the user account condition includes a vehicle speed, the communication circuitry is configured to receive the information from the in-vehicle device including a detected vehicle speed, and the processor is configured to determine satisfaction of the user account condition by determining whether the detected vehicle speed corresponds to the vehicle speed of the user account condition.

8. The movable barrier operator of claim 1 wherein the user account condition includes a user identity, the communication circuitry is configured to receive the information from the in-vehicle device including identity data of a person in a building associated with the movable barrier operator, the processor configured to determine satisfaction of the user account condition by determining whether the identity data of the person in the building corresponds to the user identity of user account condition.

9. The movable barrier operator of claim 1 wherein the user account condition includes a plurality of user account conditions, and the processor is configured to determine the user account condition has not been satisfied unless all of the user account conditions are satisfied.

10. The movable barrier operator of claim 1 wherein the vehicle characteristic includes a location of the vehicle, the communication interface is configured to receive data representative of an area associated with the movable barrier operator, and the processor is configured to determine whether the vehicle characteristic indicates automatic operation of the movable barrier operator based at least in part on whether the location of the vehicle is within the area associated with the movable barrier operator.

11. A movable barrier operator comprising:

a motor configured to be connected to a movable barrier;

communication circuitry configured to receive data representative of a vehicle characteristic that indicates triggering of an automatic operation of the movable barrier operator;

the communication circuitry configured to receive a user account condition to be satisfied for automatic operation of the movable barrier operator to occur; and a processor operatively coupled to the motor and the communication circuitry, the processor configured to determine satisfaction of the user account condition and, upon the user account condition not being satisfied, to inhibit operation of the motor;

wherein the user account condition includes a weather condition, the communication circuitry is configured to receive weather data regarding an ambient weather condition, and the processor is configured to determine satisfaction of the user account condition by determining whether the ambient weather condition corresponds to the weather condition of the user account condition.

12. The movable barrier operator of claim 11 wherein the communication circuitry is configured to receive a radio frequency command signal from a remote control and the processor is configured to inhibit operation of the motor by ignoring the radio frequency command signal.

13. The movable barrier operator of claim 11 wherein the user account condition includes a time window, and the processor is configured to determine satisfaction of the user account condition by determining whether the vehicle characteristic occurs within the time window.

14. The movable barrier operator of claim 11 wherein the user account condition includes a plurality of user account conditions, and the processor is configured to determine the user account condition has not been satisfied unless all of the user account conditions are satisfied.

15. The movable barrier operator of claim 11 wherein the vehicle characteristic includes a location of the vehicle, the communication interface is configured to receive data representative of an area associated with the movable barrier operator, and the processor is configured to determine whether the vehicle characteristic indicates automatic operation of the movable barrier operator based at least in part on whether the location of the vehicle is within the area associated with the movable barrier operator.

16. A method of operating a movable barrier operator, the method comprising:

at the movable barrier operator:

receiving data representative of a vehicle characteristic that indicates a trigger of an automatic operation of the movable barrier operator;

receiving a user account condition from an in-vehicle device, wherein the user account condition is established at the in-vehicle device, and wherein the user account condition is to be satisfied for automatic operation of the movable barrier operator to occur;

receiving information from the in-vehicle device;

determining satisfaction of the user account condition based upon the information received from the in-vehicle device; and inhibiting, despite the trigger of the automatic operation of the movable barrier operator, operation of a motor of the movable barrier operator and movement of a movable barrier connected to the motor upon the user account condition not being satisfied based on the information.

17. The method of claim 16 further comprising receiving a radio frequency command signal from a remote control; and wherein inhibiting operation of the motor upon the user account condition not being satisfied includes ignoring the radio frequency command signal.

18. The method of claim 16 wherein the information received from the in-vehicle device includes one or more vehicle characteristics; and determining satisfaction of the user account condition is based at least in part on the one or more vehicle characteristics.

19. The method of claim 16 wherein the user account condition includes an approved user identity, wherein receiving information from the in-vehicle device includes receiving information including data indicative of an in-vehicle user identity; and wherein determining satisfaction of the user account condition includes determining whether the in-vehicle user identity corresponds to the approved user identity.

20. The method of claim 16 wherein the user account condition includes a time window and wherein determining satisfaction of the user account condition includes determining whether the vehicle characteristic occurs within the time window.

21. The method of claim 16 wherein the user account condition includes a direction of vehicle travel and wherein receiving information from the in-vehicle device includes receiving information including a detected direction of vehicle travel, wherein determining satisfaction of the user account condition includes determining whether the detected direction of vehicle travel corresponds to the direction of vehicle travel of the user account condition.

22. The method of claim 16 wherein the user account condition includes a vehicle speed and wherein receiving information from the in-vehicle device includes receiving information including a detected vehicle speed, wherein determining satisfaction of the user account condition includes determining whether the detected vehicle speed corresponds to the vehicle speed of the user account condition.

23. The method of claim 16 wherein the user account condition includes a user identity;

wherein receiving information from the in-vehicle device includes receiving information including identity data of a person in a building associated with the movable barrier operator;

wherein determining satisfaction of the user account condition includes determining whether the identity data of the person in the building corresponds to the user identity of the user account condition.

24. The method of claim 16 wherein the user account condition includes a plurality of user account conditions, and inhibiting operation of the motor upon the user account condition not being satisfied includes inhibiting operation of the motor unless all of the user account conditions are satisfied.

25. The method of claim 16 wherein the vehicle characteristic includes a location of the vehicle, the method further comprising:

receiving, at the movable barrier operator, data representative of an area associated with the movable barrier operator; and wherein determining whether the vehicle characteristic indicates automatic operation of the movable barrier operator is based at least on part on whether the location of the vehicle is within the area associated with the movable barrier operator.

26. A method of operating a movable barrier operator, the method comprising:

at the movable barrier operator:

receiving data representative of a vehicle characteristic that indicates a trigger of an automatic operation of the movable barrier operator;

receiving a user account condition from a remote server computer, wherein the user account condition is to be satisfied for automatic operation of the movable barrier operator to occur;

determining satisfaction of the user account condition;

inhibiting operation of a motor of the movable barrier operator and movement of a movable barrier connected to the motor upon the user account condition not being satisfied;

wherein the user account condition includes a weather condition, the method further comprising receiving, at the movable barrier operator, weather data regarding an ambient weather condition; and wherein determining satisfaction of the user account condition includes determining whether the ambient weather condition corresponds to the weather condition of the user account condition.

27. A non-transitory computer readable medium including instructions that, when executed by a computing device, cause the computing device to perform operations comprising:

at a movable barrier operator:

receiving data representative of a vehicle characteristic that indicates a trigger of an automatic operation of the movable barrier operator;

receiving a user account condition from an in-vehicle device, wherein the user account condition is established at the in-vehicle device, and wherein the user account condition is to be satisfied for automatic operation of the movable barrier operator to occur;

receiving information from the in-vehicle device;

determining satisfaction of the user account condition based upon the information received from the in-vehicle device; and inhibiting, despite the trigger of the automatic operation of the movable barrier operator, operation of a motor of the movable barrier operator and movement of a movable barrier connected to the motor upon the user account condition not being satisfied based on the information.

* * * * *